United States Patent [19]

Riddle et al.

[11] Patent Number: 4,730,435

[45] Date of Patent: Mar. 15, 1988

[54] STERILE DOCKING SYSTEM FOR FILLING IV BAGS

[75] Inventors: Richard A. Riddle, Brown Deer; Natale J. Cerami, Waukesha; Deborah L. Jackman, Hartford, all of Wis.

[73] Assignee: Aqua-Chem, Inc., Milwaukee, Wis.

[21] Appl. No.: 849,109

[22] Filed: Apr. 7, 1986

[51] Int. Cl.[4] ..... B05B 55/18

[52] U.S. Cl. ..... 53/167; 53/258; 53/168; 53/373; 53/426

[58] Field of Search ..... 53/167, 258, 268, 373, 53/426; 156/583.9; 100/291, 292

[56] References Cited

U.S. PATENT DOCUMENTS

| | | | |
|---|---|---|---|
| 2,639,069 | 5/1983 | West | 53/253 X |
| 2,787,875 | 4/1957 | Johnson | 53/373 X |
| 2,927,974 | 3/1960 | Morrison | 53/373 |
| 2,930,170 | 3/1960 | Holsman | 53/268 X |
| 2,970,417 | 2/1961 | Parks | 53/373 X |
| 3,089,298 | 5/1963 | Neundorf | 53/373 X |
| 3,491,503 | 1/1970 | Ashton et al. | 53/426 |
| 3,782,068 | 1/1974 | Woynden | 53/253 X |
| 4,452,030 | 6/1984 | Inada | 53/471 |
| 4,494,363 | 1/1985 | Rica | 53/268 X |
| 4,530,202 | 7/1985 | Powell et al. | 53/426 |

*Primary Examiner*—John Sipos

*Attorney, Agent, or Firm*—John C. Cooper, III; Fred Wiviott; C. Thomas Sylke

[57] ABSTRACT

An apparatus for aseptically filling and sealing preformed bags includes a carousel table supporting a number of bags along its periphery, each bag having a nozzle initially sealed by a diaphragm. As the carousel table brings an individual bag under a sterile docking unit, that unit lowers over the bag and showers the nozzle and diaphragm with HEPA filtered air to remove particulate matter and bioburden. A flash heat sterilizer sterilizes the diaphragm and the top of the nozzle and at least partially melts the diaphragm. A heat sterilized fill pipe descends, piercing the diaphragm and filling the bag. When filling is completed, the fill pipe partially withdraws, the lower portion of the pipe remaining inserted in the nozzle. A heat sealer then seals the nozzle below the tip of the pipe. The pipe completely withdraws, the sterile docking unit moves clear of the bag, and the carousel table rotates, thus moving an empty bag into position for filling.

17 Claims, 5 Drawing Figures

STERILE DOCKING SYSTEM FOR FILLING IV BAGS

BACKGROUND OF THE INVENTION

1. Field of the Invention—The present invention relates generally to the art of filling flexible containers or bags with sterile fluids, and more particularly to a system for automatically filling intravenous (IV) solution bags at a high rate of speed in a sterile, aseptic manner without requiring a clean room or other sterile environment or extensive sterilizing of equipment.

2. Description of the Related Art—The presence of particulates and viable organisms must be kept within specified limits when filling flexible containers.

Depending on the solution, filling with very low levels of viable contamination may be allowed when sterility is thereafter achieved by a subsequent sterilizing process. Alternatively, the solution may be produced sterile and transferred into the flexible container by an aseptic filling process which maintains sterility by excluding viables.

In prior practice, flexible containers were filled in a clean room under a hood capable of maintaining sanitary conditions within specified limits. For aseptic filling, bags would initially be sterilized internally and at least partially externally and kept at a very low level of contamination during the filling process. It was essential that a high degree of care be maintained throughout all phases of a controlled or aseptic filling process. IV bags were subsequently sterilized after filling to ensure the required sterility even if originally filled by highly controlled methods.

Methods and machines are currently used in related areas of the art to minimize human labor (and therefore the threat of contamination) and to utilize automated processes where possible. These methods and machines, however, have certain significant shortcomings. Many machines are not able to use preformed bags or containers. Filling IV bags in these machines is an integral part of manufacturing the bags. See, for example, U.S. Pat. Nos. 3,269,079 issued on Aug. 30, 1966 to Schmied for "Method of and Apparatus for Sterile Packaging of Sterile Consumer Goods"; 3,376,687 issued on Apr. 9, 1968 to Gewecke for "Method of Preparing a Packaged Parenteral Solution"; 3,466,841 issued on Sept. 16, 1969 to Rausing for "Method of Packaging Sterile Filling Material Under Aseptic Conditions"; 3,538 669 issued on Nov. 10, 1970 to Broman et al. for "Method of Preparing a Packaged Sterile Solution"; 4,045 939 issued on Sept. 6, 1977 to Baumstingl for "Process for the Production of a Packaging Receiving a Sterile Liquid"; and a 4,417,607 issued on Nov. 29, 1983 to Scholle et al. for "Apparatus and Method for Aseptically Filling Flexible Containers." It is impossible to separate the filling and bag production aspects of these processes.

Additionally, many machines designed to fill preformed bags utilize bags that require a cap member to be attached after the filling process. The presence of these caps demands the use of an additional, complex mechanism for removing and replacing the caps. The filling equipment usually must also include a threaded adapter means to accomplish an airtight seal for filling. See, for example, U.S. Pat. Nos. 4,530,202 issued on July 23, 1985 to Powell et al. for "Container Filling Machine and Method"; and 4,452,030 issued on June 5, 1984 to Inada for "Contamination-free Method and Apparatus for Filling Spouted Bags With a Fluid."

Several systems require the entire bag or container to be completely sterilized (i.e., internally and externally) as well as sterile conditions in the filling chamber of the machine during each cycle of the filling process. This requires a large quantity of sterilizing agent and, in cases of large scale production, considerably slows the production of filled bags or containers. See, for example, U.S. Pat. No. 3,486,295 issued on Dec. 30, 1969 to Rausing et al. for "Method of Packaging Sterile Liquids."

Several patents recite and disclose the steps common to most any bag filling system. See, for example, U.S. Pat. Nos. 2,949,712 issued on Aug. 23, 1960 to Bieberdorf et al. for "Liquid Packaging Method"; 3,403,064 issued on Sept. 24, 1968 to Bellamy for "Method of Forming a Composite Plastic Container With an Inner and Outer Seal"; 3,514,919 issued on June 2, 1970 to Ashton et al. for "Packaging Fluids"; and 3,531,908 issued on Oct. 6, 1970 to Rausing et al. for "Method of Sterilizing and In Aseptic Conditions Filling a Flexible Container With a Sterile Liquid." These patents do not disclose any specific or efficient means for implementing the steps of the filling process. They therefore provide minimal guidance to one who wishes to incorporate the principals in an efficient production system.

The devices described above also are labor intensive and do not use automated processes to the fullest extent possible. Human labor has typically been required at one or more points in the process, thus increasing the risk of contamination and the precautions needed to insure safe processing. In U.S. Pat. No. 3,491,503 issued Jan. 27, 1970 to Ashton, et al. for "Methods and Apparatus for Filling Presterilized Containers," means are disclosed for aseptically filling a preformed bag. The second filling tube is inserted into the machine and is clamped. The outer end of the fill tube is then opened and sterilized. A pressure differential is used to keep the tube opened. Once the tube's outer end is sterilized, the clamp is removed, the bag is filled through the tube and finally, the tube is again sealed using heat sealing. The device employs several manually operated controls.

In U.S. Pat. No. 4,494,363 issued Jan. 22, 1985 to Rica, et al. for "Method and Apparatus for Aseptically Filling Containers," a machine for filling preformed bags is disclosed. A bag is secured to the machine and a vacuum head removes a lid covering a tubular fitment from the bag. The engaged fitment, the entire fill chamber, the lid, the lid removing means and the fill tube of the machine are all sterilized. Then the fill tube lowers, engages the bag fitment and fills the bag. Thereafter, the lid is heat sealed onto the end of the fitment and the bag is removed.

OBJECTS AND SUMMARY OF THE INVENTION

A primary object of the present invention is to provide an apparatus for aseptically filling flexible containers, particularly IV bags, which overcomes the aforementioned disadvantages and limitations of the devices found in related areas of the art.

Another object of the present invention is to provide an apparatus for aseptically filling IV bags which can be employed with preformed bags.

A further object of the present invention is to provide an apparatus for aseptically filling flexible containers which does not require a repetitive step of sterilizing the bag exterior before introduction of the fluid.

Yet another object of the present invention is to provide an apparatus for aseptically filling IV bags which is fully automated, i.e., not requiring human labor and the added risk of contamination that accompanies human participation in the process.

A different object of the present invention is to provide an apparatus for aseptically filling flexible containers which does not require a clean room environment or a hood for the entire filling process and which can accept bags externally contaminated by uncontrolled exposure to ambient conditions.

How these and further objects of the invention are accomplished will be described by reference to the following description of a preferred embodiment of the invention taken in conjunction with the FIGURES. Generally, however, the objects are accomplished in an automatic machine having a carousel table with a number of IV bags attached to its periphery. The carousel table is driven by an indexing motor that brings individual bags to a filling station under a sterile docking device. At the filling station, an empty IV bag is aseptically filled with a parenteral fluid such as sterile water for injection (WFI) or a sterile resuscitation fluid. Each bag is a thermal-plastic bag with a semi-rigid nozzle at the top. The nozzle is covered with a diaphragm sealing off internal access to the bag. As an individual bag is brought under the sterile docking device at the filling station, it is cleaned externally by a shower of HEPA (High Efficiency Particulate Air) filtered air from above. The diaphragm is then partially melted and then flash heat sterilized. A fill tube then extends into the bag, fills the bag with fluid, and then partially retracts. At this point, while the fill tube is still partially inserted, the bag nozzle is heat sealed at a point below the tip of the tube. The tube is then fully withdrawn and the bag is rotated out from under the sterile docking device. Throughout the operation of the sterile docking device, the HEPA filtered laminar air flow is utilized to prevent bioburden and particulate buildup on the bag and within the sterile docking device. Other variations may appear to those skilled in the art after reading this specification and are deemed to fall within the scope of the present invention if they fall within the scope of the claims which will follow the description of the preferred embodiment.

DESCRIPTION OF THE PREFERRED EMBODIMENT

Figure 1:
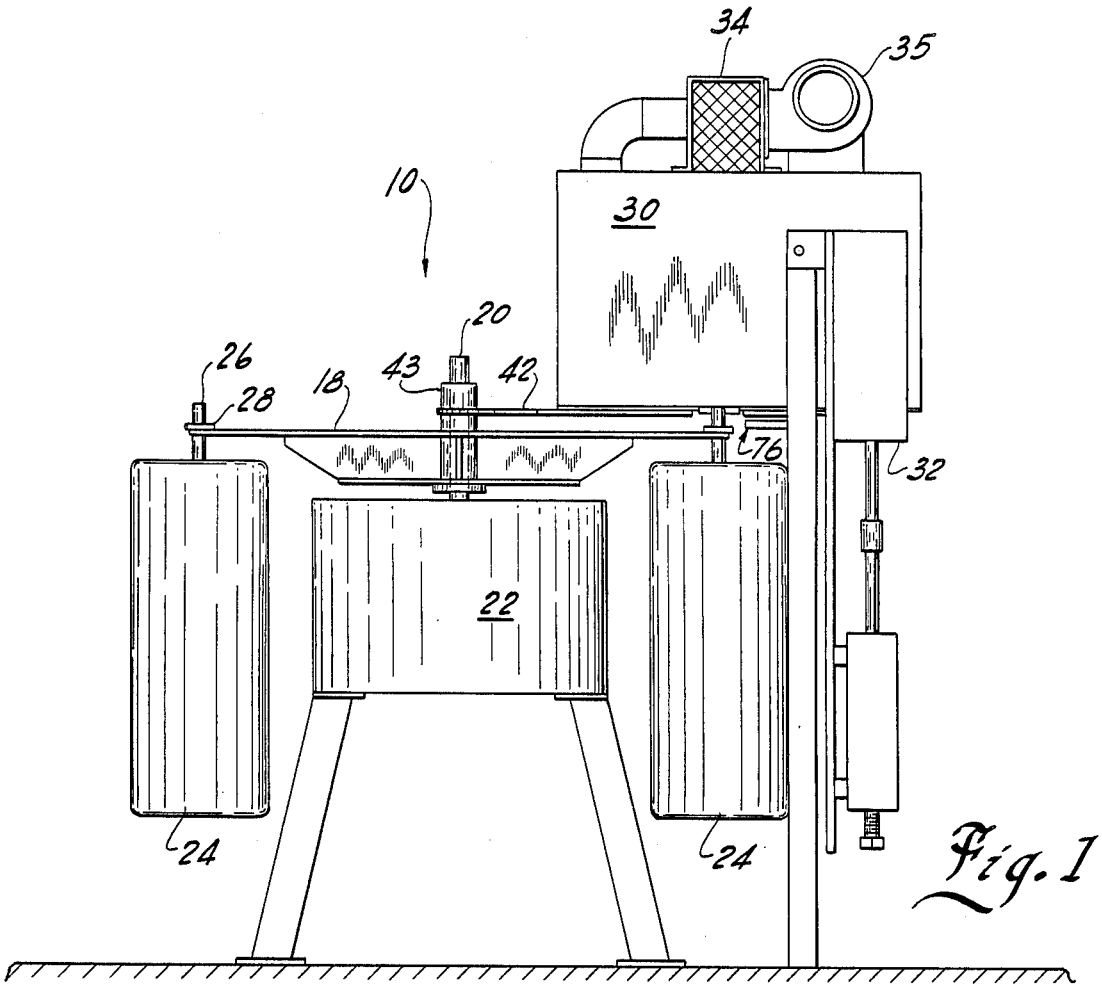
FIG. 1 is a front elevation view of the preferred embodiment of the present invention.

An apparatus 10, the preferred embodiment of the present invention, is shown in FIG. 1. A carousel table 18 is mounted on shaft 20. Shaft 20 is in turn driven by indexing motor 22 which rotates the carousel table 18 in small angular increments. Attached to table 18 are a number of IV bags 24. Typically, a bag 24 is a 1-liter bag made of thermo-plastic material. The bags 24 are externally contaminated throughout the operation of apparatus 10. The interiors, however, are maintained in a sterile condition from the time of manufacture through the filling process. Each bag 24 includes a nozzle 26 and a collar 28 around nozzle 26 to support the bag 24 on table 18. The top of nozzle 26 also has a diaphragm 27 (See FIG. 3) preferably made of a material such as PVC plastic.

Figure 2:
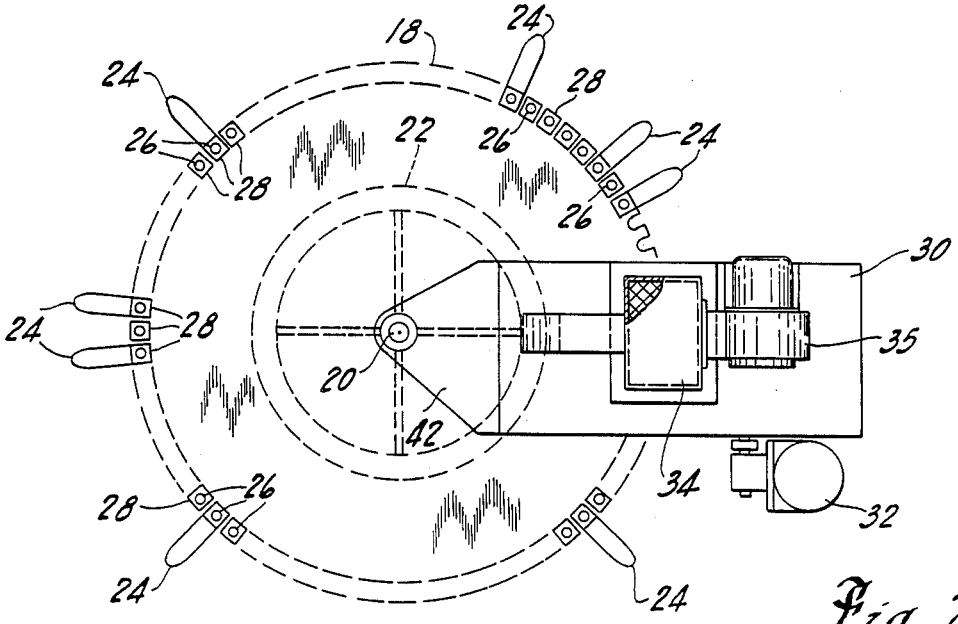
FIG. 2 is a top plan view of the apparatus shown in FIG. 1, with parts cut away to illustrate some of the internal features.

Table 18 rotates and, in turn, brings each bag 24 under a sterile docking device 30, as can be seen in FIG. 2. Attached to the sterile docking device 30 is a fill pump 32 designed to pump a liquid, such as sterile water for injection, through various components of the sterile docking device 30 into individual bags 24. Also attached to the sterile docking device 30 is a HEPA filter 34 and air blower 35. Filter 34 provides purified air for maintaining highly sanitized conditions around bag nozzle 26 and diaphram 27 during filling. Because of the unique construction of apparatus 10, it may operate outside environments typically required for other filling devices found in related areas of the art.

Figure 3:
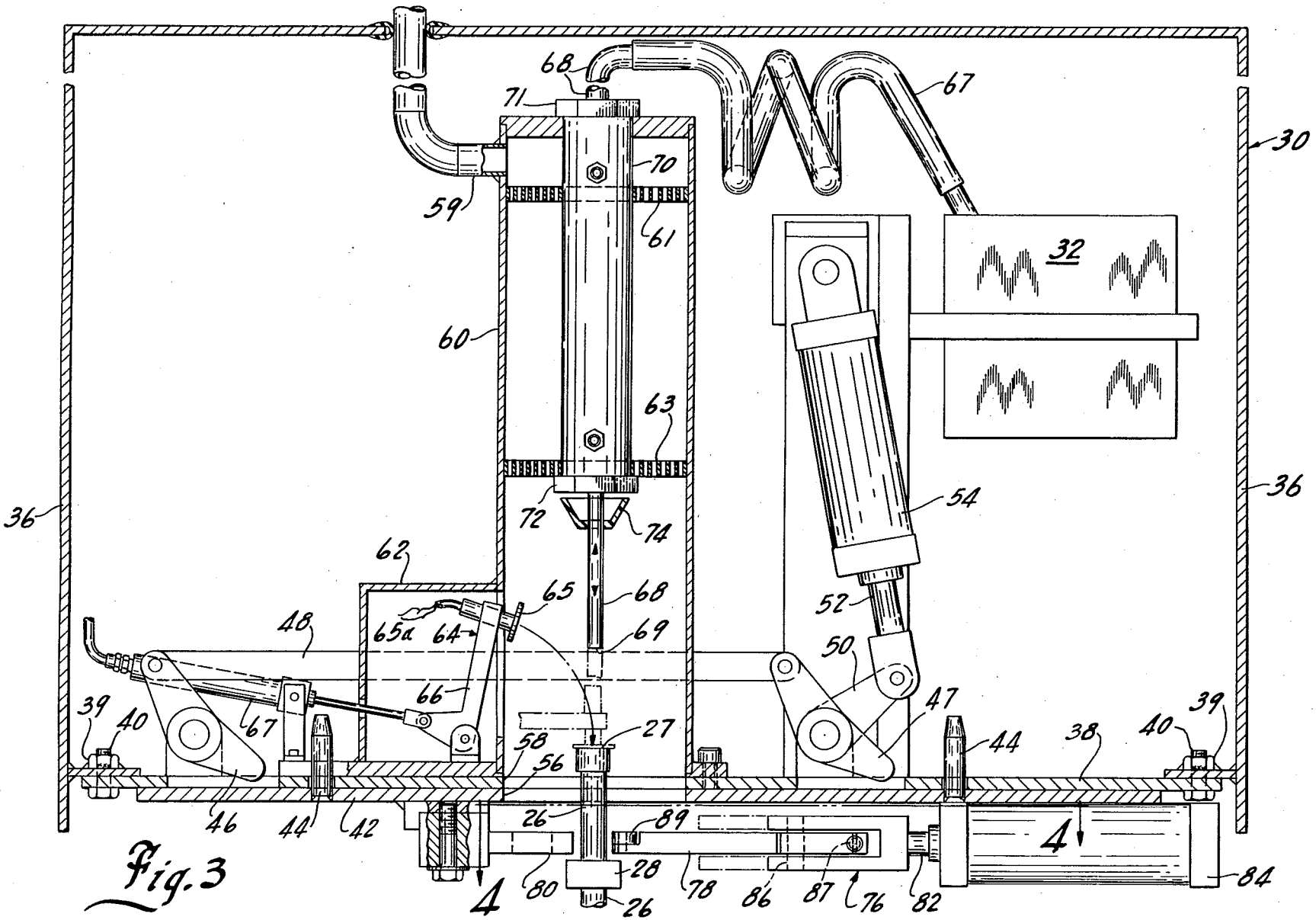
FIG. 3 is a detailed side view of the sterile docking component of the present invention.

FIG. 3 illustrates the structure of the sterile docking device 30 in more detail. The components of the device 30 are covered by a cabinet 36 and supported by a support table 38. Cabinet 36 and support table 38 are secured to one another by nuts 39 and bolts 40. Located beneath support table 38 is a fixed table 42, attached to a stationary fitting 43 around shaft 20, as seen in FIG. 1. Device 30 is not attached to another component of apparatus 10, but is held in proper position by pins 44. Device 30 is raised and lowered by means of a pair of cams 46, 47 connected by bar 48. Cam 47 is in turn connected via arm 50 to a rod 52. The position of rod 52 is controlled by cylinder 54. In FIG. 3, rod 52 is in its retracted position, meaning the sterile docking device 30 is in its lower position.

There is a hole 56 in fixed table 42, permitting clearance for bag 24 and its nozzle 26. There is a similar hole 58 in the support table 38. A steady flow of HEPA filtered laminar air is maintained toward and through these holes. The air is introduced through a duct 59 leading into chamber 60. Chamber 60 is generally cylindrical and preferably made of polished 316 stainless steel. Two air flow straighteners 61, 63 are placed in chamber 60 to ensure a laminar flow of HEPA air.

Adjacent to hole 58 at the bottom of chamber 60 is a flash heat sterilizer 64. In the preferred embodiment, sterilizer 64 consists of a metal rod 66 and heater 65 heated by electrical resistance via wires **65*a*, and is mounted inside a housing 62 adjacent to chamber 60. During operation in the preferred embodiment, heater 65 is pivoted down by cylinder 67 into contact with diaphragm 27, heating it to a temperature of approximately 200° C. This not only sterilizes the entire surface of diaphragm 27, but additionally melts part of the diaphragm. During this melting, any particulate matter on or around diaphragm 27 is trapped in the melted plastic. Heater 65** is then pivoted back to a ready position illustrated in full line in FIG. 3.

Within chamber 60 is a fill tube 68. Fill tube 68 is preferably an elongate metal tube with a rounded lower tip 69. The upper end of fill tube 68 is connected to a flexible hose 67 supplying fluid from fill pump 32. Tube 68 is preferably auto heat sterilized by electrical resistance heating at a preselected frequency.

Fill tube 68 passes through a pneumatic cylinder 70 mounted to the top of chamber 60 and lower air flow straightener 63 with brackets 71, 72. Tube 68 additionally acts as the rod of cylinder 70 in the preferred embodiment and therefore is mounted to and extends through the piston of cylinder 70. Thus, when the piston of cylinder 70 is lowered, the fill tube 68 also lowers. There is sufficient slack and elasticity in hose 67 to allow considerable vertical movement of fill tube 68. Trap 74 is mounted on tube 60 immediately below lower bracket 72 to catch particulate matter that would otherwise fall into critical areas.

In its raised position, tube 68 is clear of the flash heat sterilizer 64. In the lowest position, tube 68 is inserted into bag 24 through nozzle 26. Diaphragm 27 is only partially melted, so lower end 69 pierces the remnant material covering nozzle 26. When tube 68 penetrates the remaining material, that material presses against tube 68 and provides a close seal between tube 68 and nozzle 26.

When filling of the bag 24 is completed, tube 68 partially withdraws to an intermediate position. Tube 68 is still in contact with nozzle 26; however, a portion of nozzle 26 is empty. At this point, a heat sealing operation is performed, preferably by a radio frequency heat sealer 76 located beneath fixed table 42.

Figure 4:
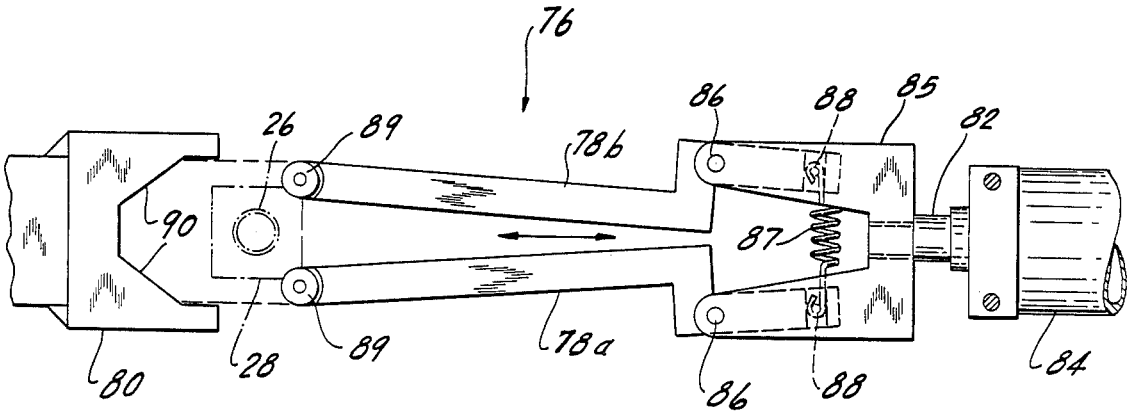
FIG. 4 is a top view of the heat sealer, in its withdrawn position, taken along the line 4—4 of FIG. 3.

Referring to FIG. 4, heat sealer 76 consists generally of two components—a ramp 80 and heating element 78. Ramp 80 is generally V-shaped having converging faces 90 the function of which will be discussed below. Heating element 78 has matching members **78*a*, 78*b*. Members 78*a*, 78*b* are pivotably attached to a mounting 85 by pins 86 and are biased apart by a tension spring 87 attached behind pins 86 by a second pair of pins 88. Mounting 85 is also attached to a rod 82. Rollers 89 are rotatably mounted on the front of members 78*a*, 78. The space between rollers 89, at its maximum, is approximately the same as the maximum space provided by ramp 80**.

Figure 5:
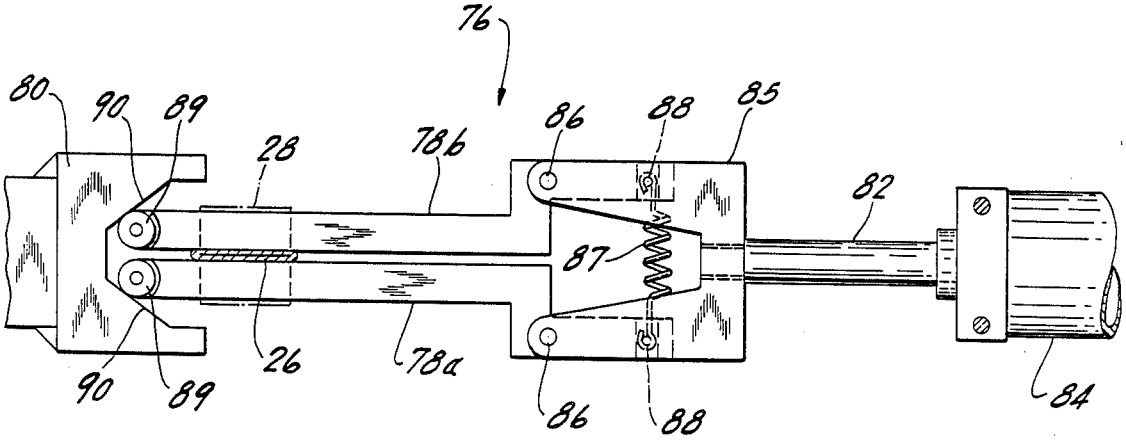
FIG. 5 is a top view of the heat sealer of FIG. 4 in its second pinching position.

When filling is completed and the tube 68 is in its intermediate position, cylinder 84 causes rod 82 to extend. As rod 82 extends, rollers 89 engage ramp 80 and are forced together by faces 90. As the rollers 89 and members **78*a*, 78*b* come together, they seal nozzle 26, as seen in FIG. 5. When sealing is completed, rod 82 retracts. Members 78*a*, 78*b* open as a result of the biasing of tension spring 87 and pivoting pins 86. Simultaneously, tube 68 is fully retracted to its raised position shown in FIG. 3**.

OPERATION

Apparatus 10 is prepared for operation by filling the load track of carousel table 18 with a number of empty IV bags 24. Indexing motor 22 moves a bag 24 into the filling station directly below the sterile docking device 30. Once bag 24 is positioned beneath hole 56 of fixed table 42 and hole 58 of support table 38, rod 52 retracts, thus lowering the sterile docking device 30 over and around nozzle 26 and diaphragm 27 of bag 24.

At this point, a HEPA filtered laminar air flow removes loose dirt from the top and upper sides of the fill nozzle 26. Because of the direction of the air flow, dirt and bacteria are carried away from the fill area.

Simultaneously, the flash heat sterilizer 64 pivots down, with heater 65 sterilizing nozzle 26 and partially melting diaphragm 27. Heater 65 then returns to its original position. The piston in cylinder 70 then moves downward, inserting the lower portion of fill tube 68 into bag 24. Particulate trap 74 is positioned on tube 68 so that dirt and other matter is contained without contaminating the top of bag 24. Fluid is then pumped into the bag 24 to fill it. Tube 68 partially then retracts, moving to its intermediate position. At this point, the tip 69 of tube 68 is still beneath nozzle 26 and inside bag 24. However, tube 68 is removed far enough so that the heating element 78 of the radio frequency heat sealer 76 can close and seal the bag 24 immediately above collar 28.

With the filling and sealing procedure completed, rod 52 of cylinder 54 extends, rotating cams 46 and 47, thus raising the sterile docking device 30. The carousel table 18 rotates and another bag is positioned beneath device 30.

It will be readily apparent and obvious to those skilled in the art that a number of changes and modifications may be made without departing from the spirit and scope of the present invention. For example, alternate configurations of mechanical elements may be used to accomplish the same functions. Therefore, the above illustrated and described preferred embodiment serves as illustrative rather than limiting, the scope of the invention being limited only by the claims that follow.

We claim:

1. An apparatus for aseptically filling and sealing preformed flexible bags, said apparatus comprising:

(a) a frame, including a central shaft;

(b) a carousel table rotatably mounted to said shaft, said carousel table designed to hold a plurality of bags around the periphery of said table, each of said bags comprising an elongate nozzle and a circular diaphragm sealing the top thereof;

(c) means for positioning an individual bag in an operational position; and (d) a sterile docking unit located above said carousel table, said sterile docking unit comprising:

(1) an open-bottom housing positioned above said carousel table;

(2) means for generating a downward laminar air flow through said housing;

(3) filler means within said housing;

(4) sterilizing means within said housing designed to sterilize the diaphragm and upper portion of the nozzle of a bag in said operational position, wherein said sterilizing means comprises:

a sterilizing element movable between a first position wherein said sterilizing element is clear of the travel path of said filler means and the nozzle of a bag in said operational position, and a second position wherein said sterilizing element and said diaphragm are in concentric contact;

means connected to said sterilizing means for heating said sterilizing element to a temperature sufficient to sterilize said diaphragm and the upper portion of the nozzle and to at least partially melt said diaphragm; and means to move said sterilizing element between said first and second positions; and (5) sealing means, located beneath and adjacent to said housing adapted to seal the nozzle of a bag in the operational position.

2. The apparatus as recited in claim 1 wherein said positioning means includes:

(a) a fixed support table attached to said frame;

(b) a planar member constituting the floor of said sterile docking unit, said floor being movable between a first lower position and a second raised position, where said floor in said lower position lies on top of said support table;

(c) means to lift said sterile docking unit, said lifting means comprising a plurality of cams actuated by a cylinder such that actuation of the cams moves said sterile docking device from said lower position to said raised position; and (d) an indexing motor designed to drive said carousel table such that an empty bag rotates into said operational position when said floor of said sterile docking unit is in said second raised position.

3. The apparatus as recited in claim 1 wherein said air flow generating means comprises:

(a) a duct in the upper portion of said housing, said duct providing a flow of HEPA filtered air to said housing; and (b) a plurality of air flow straighteners located below said duct within said housing, said straighteners designed to direct air flow downward in a laminar fashion.

4. The apparatus as recited in claim 1 wherein said filler means comprises:

(a) a fill pump adjacent said housing and providing fluid to said sterile docking unit;

(b) a fill pipe positioned coaxially with the nozzle of a bag in said operational position;

(c) flexible tube means connecting said fill pipe and said fill pump; and (d) sequencing means for moving said fill pipe between:

(1) a first raised standby position such that said positioning means and said sterilizing means operate while said fill pipe is in said standby position;

(2) a second lower filling position such that said fill pump operates and the bag in said operational position is filled with fluid while said pipe is in said filling position; and (3) a third intermediate sealing position in which said sealing means operates to heat seal the nozzle of a filled bag in said operational position while said fill pipe is in said intermediate position.

5. The apparatus as recited in claim 4 wherein said sequencing means comprises a cylinder in which the fill pipe constitutes the piston rod thereof so that as the piston of said cylinder moves vertically, said fill pipe moves vertically in parallel fashion.

6. The apparatus as recited in claim 1 wherein said sterilizing element moving means is an arm, pivotably attached adjacent to the bottom of said housing, said sterilizing element being attached to said arm, movement of said arm being accomplished by a pneumatic cylinder and rod attached thereto.

7. The apparatus as recited in claim 6 wherein said sealing means comprises:

(a) a ramp fixed adjacent the nozzle of a bag in said operational position;

(b) a heating element having first and second segments designed to engage said ramp, and being in diametrical opposition to said ramp relative to the nozzle and movable between a first withdrawn position in which said heating element is spaced apart from said ramp and said segments are spaced apart from each other an a second pinching position, such that when said heating element is in said pinching position, sufficient pressure and heat are applied to the bag nozzle by said segments while engaging said ramp so as to seal said nozzle; and (c) cylinder and rod means connected to said heating element and designed to move said heating element between said first and second positions.

8. The apparatus as recited in claim 7 wherein said segment are two generally parallel members pivotably mounted so that as said heating element moves from said first withdrawn position to said second pinching position, said members are forced together on opposite sides of said nozzle by said ramp thereby pinching and sealing said nozzle.

9. An apparatus for aseptically filling and sealing preformed containers, said apparatus comprising:

(a) means for conveying a number of preformed containers, said conveying means periodically moving an individual container into an operational position, each of said individual containers having an elongate nozzle sealed by a circular diaphragm; and (b) a sterile docking unit above and conveying means, said sterile docking unit comprising:

(1) an open-bottomed housing positioned above said conveying means;

(2) means for generating a downward laminar air flow through said housing;

(3) filler means within said housing;

(4) sterilizing means within said housing designed to sterilize the diaphragm and upper portion of the nozzle of a container in said operational position, wherein said sterilizing means comprises:

a sterilizing element movable between a first position, wherein said sterilizing element is clear of the travel path of said filler pipe and the nozzle of a bag in said operational position, and a second position, wherein said sterilizing element and said diaphragm are in concentric contact;

means connected to said sterilizing means for heating said sterilizing element to a temperature sufficient to sterilize said diaphragm and the upper portion of the nozzle and to at least partially melt said diaphragm; and means to move said sterilizing element between said first and second positions; and (5) sealing means, beneath said housing designed to seal a container in said operational position.

10. The apparatus as recited in claim 9 wherein said conveying means includes:

(a) means for holding a number of containers;

(b) support means including a frame, above said holding means, designed to support said sterile docking unit;

(c) means for moving said sterile docking unit between a first lower position wherein the upper portion of the nozzle of a container in said operational position is surrounded by said housing, to a second higher position which allows movement of a filled container away from said operational positional and movement of an empty container into said operational position.

11. The apparatus as recited in claim 10 wherein:

(a) said holding means is a generally circular carousel table designed to hold containers along its periphery, said carousel table being driven by an indexing motor adjacent thereto;

(b) said support means is a fixed table attached to said frame; and (c) said moving means is a plurality of cams within said sterile docking unit, said cams being actuated by a cylinder and actuation rod.

12. The apparatus as recited in claim 9 wherein said air flow generating means comprises:

(a) a duct in the upper portion of said housing, said duct providing a flow of HEPA filtered air to said housing; and (b) a plurality of air flow straighteners located below said duct within said housing, said straighteners designed to direct air flow downward in a laminar fashion.

13. The apparatus as recited in claim 9 wherein said filler means comprises:

(a) a fill pump adjacent said housing and providing fluid to said sterile docking unit;

(b) a fill pipe positioned coaxially with the nozzle of a bag in said operational position;

(c) elastic tube means connecting said fill pipe and said fill pump; and (d) sequencing means for moving said fill pipe between:

(1) a first raised standby position such that said positioning means and said sterilizing means operate while said fill pipe is in said standby position;

(2) a second lower filling position such that said fill pump operates and the container in said operational position is filled with fluid while said pipe is in said filling position; and (3) a third intermediate sealing position such that said sealing means operates to heat seal the nozzle of a filled container in said operational position while said fill pipe is in said sealing position.

14. The apparatus as recited in claim 13 wherein said sequencing means comprises a cylinder in which the fill pipe constitutes the piston rod so that as the piston of said cylinder moves vertically, said fill pipe moves vertically in parallel fashion.

15. The apparatus as recited in claim 9 wherein said sterilizing element moving means is an arm, pivotably attached adjacent to the bottom of said housing, to which said sterilizing element is attached, movement of said arm being accomplished by a pneumatic cylinder and rod attached thereto.

16. The apparatus as recited in claim 9 wherein said sealing means comprises:

(a) a ramp fixed adjacent the nozzle of a bag in said operational position;

(b) a heating element having first and second segments designed to engage said ramp, and being in diametrical opposition to said ramp relative to the nozzle and movable between a first withdrawn position in which said heating element is spaced apart from said ramp and said segments are spaced apart from each other and a second pinching position, such that when said heating element is in said pinching position, sufficient pressure and heat are applied to the bag nozzle by said segments while engaging said ramp so as to seal said nozzle; and (c) cylinder and rod means connected to said heating element and designed to move said heating element between said first and second positions.

17. The apparatus as recited in claim 16 wherein said segments are two generally parallel members pivotably mounted so that as said heating element moves from said first withdrawn position to said second pinching position, said members are forced together on opposite sides of said nozzle by said ramp thereby pinching and sealing said nozzle.

* * * * *